US006237486B1

(12) United States Patent
Firth

(10) Patent No.: US 6,237,486 B1
(45) Date of Patent: May 29, 2001

(54) SCREEN PRINTING APPARATUS AND METHOD FOR CURVED LAMINATED SKATEBOARDS

(76) Inventor: Gregory S. Firth, 735 Vale View Dr., Vista, CA (US) 92083

( * ) Notice: Subject to any disclaimer, the term of this patent is extended or adjusted under 35 U.S.C. 154(b) by 0 days.

(21) Appl. No.: 09/504,228

(22) Filed: Feb. 15, 2000

(51) Int. Cl.[7] ..... B41F 17/30
(52) U.S. Cl. ..... 101/123; 101/38.1
(58) Field of Search ..... 101/114, 115, 101/123, 124, 126, 38.1, 39, 40, 40.1

(56) References Cited

U.S. PATENT DOCUMENTS

| | | | | |
|---|---|---|---|---|
| 4,254,706 | | 3/1981 | Lala | 101/38 |
| 4,502,380 | * | 3/1985 | Meader | 101/126 |
| 4,782,750 | | 11/1988 | Marette | 101/39 |
| 5,207,156 | | 5/1993 | Helling | 101/38.1 |
| 5,333,347 | | 8/1994 | Stranders | 15/220.1 |
| 5,349,716 | | 9/1994 | Millar | 15/245 |
| 5,383,395 | | 1/1995 | Buschulte | 101/365 |
| 5,419,213 | | 5/1995 | Karlyn | 74/437 |
| 5,711,217 | | 1/1998 | Boring | 101/123 |
| 5,800,614 | * | 9/1998 | Foust | 101/126 |
| 6,089,149 | * | 7/2000 | Zelko | 101/115 |

* cited by examiner

*Primary Examiner*—Ren Yan

(57) ABSTRACT

A screen-printing apparatus and method for printing skateboards, more particularly short boards. A multi-color press with UV cure stations between successive print heads and a system for transporting short boards to multiples of stations. The present invention uses a screen-printing process whereby; the screen is stationary, the squeegee is movable, and the short board rocks underneath the print head so that the surface during printing is always parallel to the screen. Compensation for the concave midsection is achieved by using a modified squeegee, which is able to change shape at the precise time.

1 Claim, 5 Drawing Sheets

SCREEN PRINTING APPARATUS AND METHOD FOR CURVED LAMINATED SKATEBOARDS

BACKGROUND

A common method for decorating the underside portion of a skateboard deck is screen-printing. Typically, skateboards are decorated with a screen print covering the entire underside of a deck, which is referred to as "a full pass". On top of the full pass are applied consecutive prints of different colors and patterns. This screen-printing process requires that the ink must cure before the consecutive prints can be applied. After each print, the deck is removed from a screen press and placed in a drying rack.

A particular deck, commonly known as a short board, is manufactured using plywood laminates. The laminates are formed in a molded press into a shape comprised of three basic sections, which are the nose, tail, and mid-sections. The mid-section is relatively flat but the nose and tail sections are bent at a 12-degree angle. An irregular shaped printing screen is necessary to compensate for these two angles. The curvature of the screen must closely follow the contour of the skateboard in order to successfully print. There are many complications and drawbacks that occur as a result of using curved screens. Since curved screens are not commercially available, screens must be fabricated in house. Preparing a curved screen for printing is more difficult than preparing standard flat screens because of the curvatures. A common problem with curved screens is that fabric tension is difficult to maintain when the screen has straight and curved sections. Poor fabric tension results in inferior print quality and registration. Another problem is that decks come in different sizes and shapes, which further adds to the complexity of printing. Separate screen shapes are necessary for different deck shapes.

By far the most popular skateboard shape is the short board. The short board is fabricated in a molded fashion, which includes a concave shaped mid-section with a bent nose and tail section. Screen-printing this shape by hand requires that the printer must adjust the squeegee through three different angles to complete a full pass. In addition, the printer must push down on both ends of the squeegee rubber to compensate for the concave mid-section. The pushing down on the squeegee rubber ends results in the screen mesh stretching to the immediate shape of the squeegee. The squeegee rubber becomes thereby curved. This type of hand printing requires a skill and is very tiring.

Another drawback of hand printing short boards is that ink smears around the edges of the deck making the quality of the print diminished. The smeared ink is left to dry and is scraped off at a later time using a scraping tool. This phenomena is known as "scrapping the decks". Scrapping adds considerable time and cost to the printing process.

OBJECT AND ADVANTAGES

The present invention is a multi-color automatic screen printing apparatus for short boards utilizing a multiple of UV cure stations between successive print heads with a conveying system for transporting short boards. The first of several objectives is to overcome the difficulties of using the curved screen. Another is to overcome the difficulty of printing the concave mid-section of the deck. Another objective is to eliminate the scraping-phase and slow drying phases of printing skateboards. Obviously, dramatically increased production rates would result from the use of this invention as well as improved print quality.

SUMMARY OF THE INVENTION

A short board deck is basically a three-sided object. The tail, mid, and nose sections. The nose and tail sections are relatively flat and the mid section assumes a concave shape. The nose and tail sections are also bent to a predetermined angle relative to the mid section. Screen-printing this particular shape can be achieved by several means. Following is a method for automated printing of short boards. This process is understood to have variations and is used mainly for explaining of the invention. The process begins at a loading station shown in FIG. 1 where L is a loading/unloading station. A deck is placed in a fixture F which has means to hold a deck D in registration from station to station. A swing arm conveyor A1 transports the deck fixture F from the loading station L to a position of alignment where a secondary linear conveyor C transports the deck fixture to a first print station. P A typical print station P is provided with a squeegee and a flood means 60, which travel horizontally over a flat stationary screen. S.

During the printing process, the deck D rocks under a screen S to provide a parallel platform for the squeegee during printing. A typical rocking sequence is shown in FIG. 2 where a screen S is in a non-movable registered position. The printing sequence begins with either the nose section N or the tail section T is made parallel to the underside of the screen as shown in FIG. 2*a*. When the squeegee G arrives at either axis point X or at axis point Y, the deck quickly rocks to maintain parallelism with the screen as shown in FIG. 2*b* and *c*. In this fashion the deck always remains parallel to the screen with respect to the squeegee. Rotational movement must be timed to occur as the squeegee travels to the top of the bends in the deck which are located at points X, Y. Axis points X, Y are located directly at the bends in the deck and at the print surface. If these axis points are moved out of this position then the printed image will smudge because of movement between the screen and the deck.

This rocking method may seem similar to prior art. Printing round or oval objects such as bottles is generally accomplished by rotating the object and moving the screen in sequence with the squeegee remaining stationary. Such an apparatus is exemplified in U.S. Pat. No. 5,343,804, (1994) Karlyn. Other patents such as U.S. Pat. No. 5,207,156 (1993) Helling and U.S. Pat. No. 4,782,750, (1988) Marette use the same principles of rotation. A round, elliptical, or oval shaped object such as a bottle is printed using a single axis of rotation located at the center of the radius of curvature to be printed in contrast to the short board deck where the rotational movement occurs around double axis points for the printing of one side of the object. The axes are located at the bends of the deck and not the center of rotation. Another difference is that the axes of rotation are located directly at the printing surface. This provides that no movement is generated between a stationary screen and print surface during the printing and rocking process. Another important difference between prior art and the present invention is the rate of rotation. Prior art reveals that the rotation occurs continually and at a constant rate during the printing process. The rocking of a short board deck occurs suddenly as the squeegee approaches a bend in the deck. The deck is stationary during most of the printing process except for two sudden rotational movements. Another difference between the invention and prior art is made evident in the print process explained in U.S. Pat. No. 4,254,706 (1981) Lala. This exemplary machine demonstrates the ability to print in many different fashions. The squeegee, screen, and object can all be actuated. The patent text clearly states that the screen is always moved during printing objects of revolution. This is due to the fact that registration is lost if the object rotates and the screen remains stationary. The invention of this patent has the ability to print an irregular shaped object using a fixed flat screen, movable object, and a movable squeegee, however, an automatic screen printing press capable of printing short boards is described in U.S. Pat. No. 5,711,217, (1998) Boring.

This one color apparatus operates by computing vectors, which actuate motors, which move squeegee, screen, and object in programmed movements. This press is capable of printing virtually any shaped object including a skateboard with a one-color full pass however; it must be pointed out that the object of the immediate invention is to provide a multi-color press specifically for skateboards. Producing such a machine as Boring for printing skateboards is not possible because an apparatus which has the ability to print any irregular shape; is not practical for use as an apparatus made to print a specific irregular shape in a multi-color environment. Another difference between the apparatus of Boring and the immediate invention is that the prior one uses a single axis point to actuate rotation on the object; and the immediate invention uses exclusively a two axis rotational system. The two axis rotational system creates an entirely different vector than a vector created in Boring. An illustration showing the difference between the two types of vectors is seen in FIGS. 3*a,b.*

FIG. 3*a* represents a vector V according to the prior art. A screen S is placed at a predetermined height from the object O. Axis X is the axis of rotation located at the center of the object and one continuous vector V is the line formed as the axis X moves through space to maintain parallelism with the screen. In contrast, FIG. 3*b* illustrates two vectors V1, V2 which form two separate lines over two separate axis points X,Y. These same axis points are not located at the center of rotation of the object as in the prior art but are located at the print surface.

A method for automated printing of short boards continues in reference to FIG. 1 where a short board deck has been loaded into a fixture F at station L which has been conveyed to print station P where the printing process has been completed by rocking the deck with respect to the squeegee which keeps the print surface parallel to the screen. During this same rocking/printing process, the printing squeegee must radically change from a straight shape to a curved shape at just the precise time. This is due to flat nose N and tail T surfaces and a concaved surface located at the mid-section.

In FIG. 1 a deck fixture F is conveyed to a UV cure station UV after the print is applied where focused UV light sweeps over the printed surface to provide an instant cure.

A series of deck fixtures are able to move in a linear fashion on a pair of rails 52, 53. The fixtures F are thereby conveyed through consecutive print/cure P, UV stations until they arrive at a swing arm conveyor A2. The swing aim conveyor A2 is fashioned to receive a fixture F and lock it into place during rotation. The fixture is rotated following arrow W to align to a pair of rails 56,57 located on the opposite side of the apparatus. The fixture F is conveyed by linear actuators 54, 58 ; which in line push a series of fixtures along rails 56,57; whereby the last fixture on said rail is received by swing arm conveyor A1. The fixture F is rotated following arrow R to station L where the ready printed short board is removed and a unprinted deck is loaded.

MODIFIED SQUEEGEE

The method for automated printing of short boards continues in regard to a squeegee. A modified squeegee is necessary to successfully print a short board. The squeegee must have the ability to automatically adapt or change form to reach the concaved mid section of a short board. The squeegee is constructed with means to bend and contort which furthers its ability to print on irregular shaped objects.

An automotive squeegee for cleaning curved glass surfaces such as U.S. Pat. No. 5,333,347 (1994) Stranders and U.S. Pat. No. 5,349,716 (1994) Millar assume a natural curved shape. These squeegees flattened out so as to conform to the contour of the surface being wiped by application of relatively modest force to the handle. However, using a squeegee to push a tensioned screen mesh down into an irregular shaped surface requires an external power source. There are no external power sources provided with these automotive squeegees.

A powered squeegee however has the ability to change from a straight configuration FIG. 4*b* to a curved configuration FIG. 4*c* during a single print stroke. Similar devices have been constructed in doctor blade applications typically U.S. Pat. No. 5,383,395, (1995) Buschulte. A doctor blade adjustment for the deposit of ink on a plate is crucial for printing. Computer controlled doctor blades with servo motor driven adjustments are common place in existing equipment today. However, none of these systems are specifically made for screen-printing irregular shaped objects. In contrast, the power actuated doctor blade is entirely different from a power-actuated squeegee. The power squeegee quickly and radically changes shape to press a flat screen around a semi-curved surface inside of one print cycle. This is much different than the function of the doctor blade. The doctor blade is typically scraping against a cylinder at a predetermined angle and pressure, which does not change with every print cycle.

DETAILED DESCRIPTION OF THE PREFFERED EMBODIEMENT

While the present invention will be described hereinafter with particular reference to the accompanying drawings, it is to be understood at the outset that it is contemplated that the present invention may be varied in specific detail from that illustrated and described herein while still achieving the desirable characteristics and features of the present invention. Accordingly the description which follows is intended to be understood as a broad enabling disclosure directed to persons skilled in the applicable arts, and is not to be understood as being restrictive.

Figure 5:
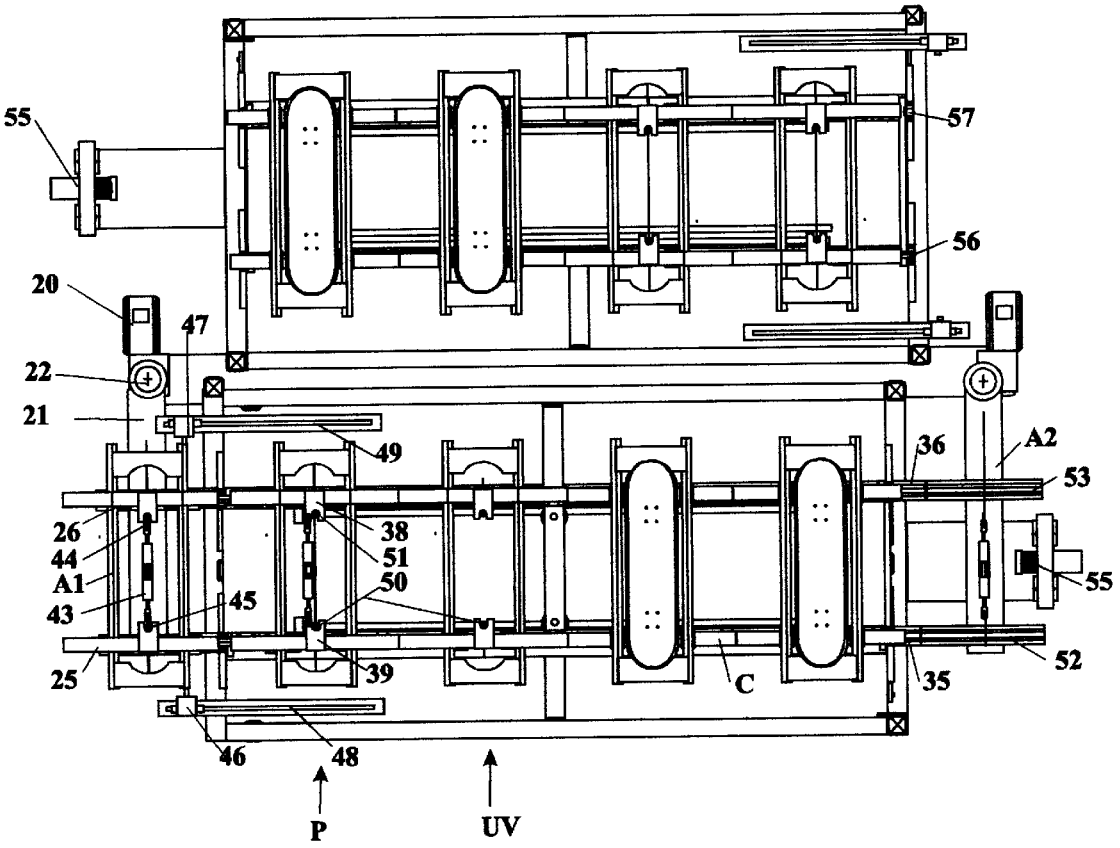
FIG. 5 Conveyor layer view from above.

The screen-printing apparatus shown in FIG. 5 is comprised of a pair of oppositely positioned modules M1, M2, which can be duplicated and placed in line to provide an apparatus, which is able to expand with more print/cure stations as needed. Multiples of modules can be placed in line with two rotational conveyors A1, A2 located at each end of the press, which revolves the fixtures to the opposite sides of the press. The present configuration is an eight-station press, which provides four printing stations P followed by four curing stations UV.

The conveyor assembly C1 has means to couple linear motion to the fixture located on the rotational conveyor A1 by using retractable registration pins 46, 47. Two parallel linear actuators 48,49 provide the linear motion for the conveyor. Swing arm conveyors A1, A2 revolve fixtures into alignment with oppositely positioned modules.

A typical swing arm conveyor A1 has a motor 20 which provides a controlled rotational movement to swing arm 21 around axis point 22. Two oppositely positioned rails 25, 26 are fixedly attached to arm 21 which provides support to linear bearing blocks as seen in FIGS. 6*a*, 27,28,29,30.

Figure 6A:
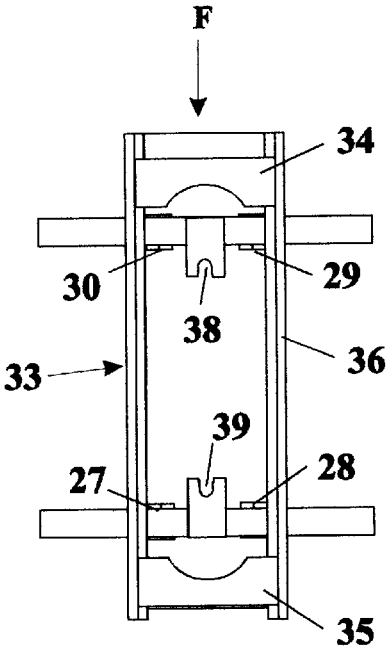
FIGS. 6*a, b* Deck Fixtures with and without a deck.
Figure 6B:
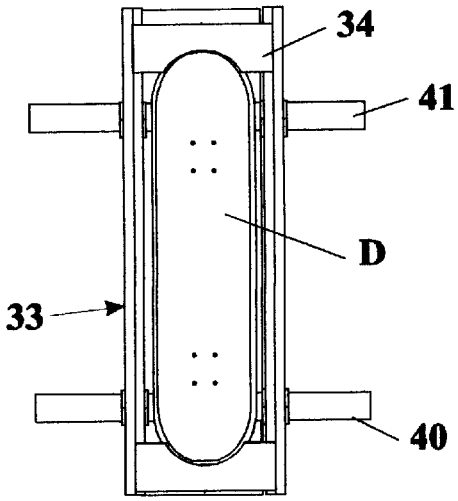

FIG. 6*a* illustrates a deck fixture F for holding a short board deck which is held in place by a spring loaded slidably mounted member 34 and an oppositely positioned member 35 which opposes the spring action. Thus the deck D is held in position between two members 34, 35 that are supported by a pair of parallel bars 36, 37. The previously mentioned bearing blocks 27,28,29,30 are attached to parallel bars 36, 37 that allow the fixture to move in a linear fashion through consecutive stations on rails. Two registration forks 38, 39 are attached to a pair of rail guards 40, 41 that are used to maintain a predetermined distance between all fixtures around the press. The registration forks 38, 39 are necessary to hold the fixture in registration during printing and rotation.

Figure 1:
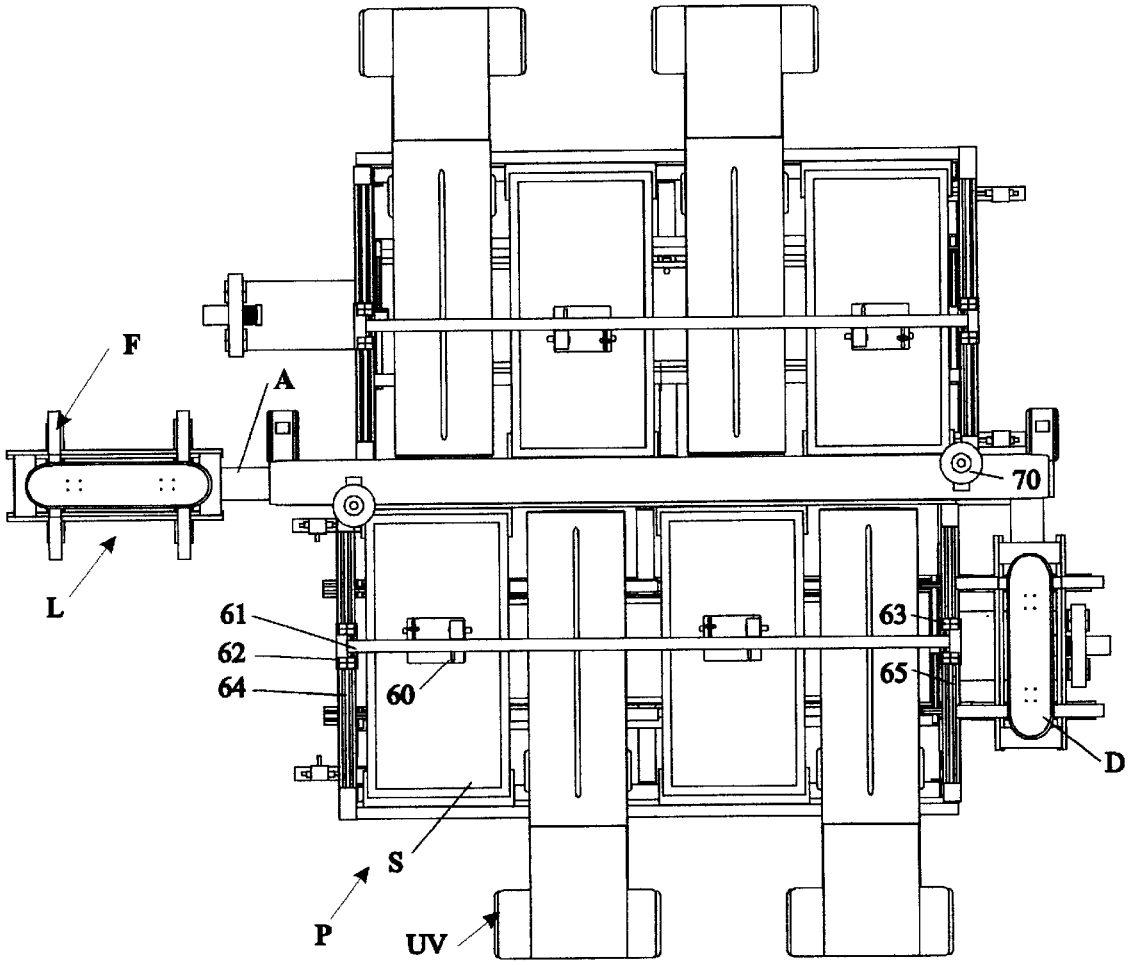
FIG. 1 View from above of an embodiment of a Multi-Color Screen Press For Short Boards.
Figure 8:
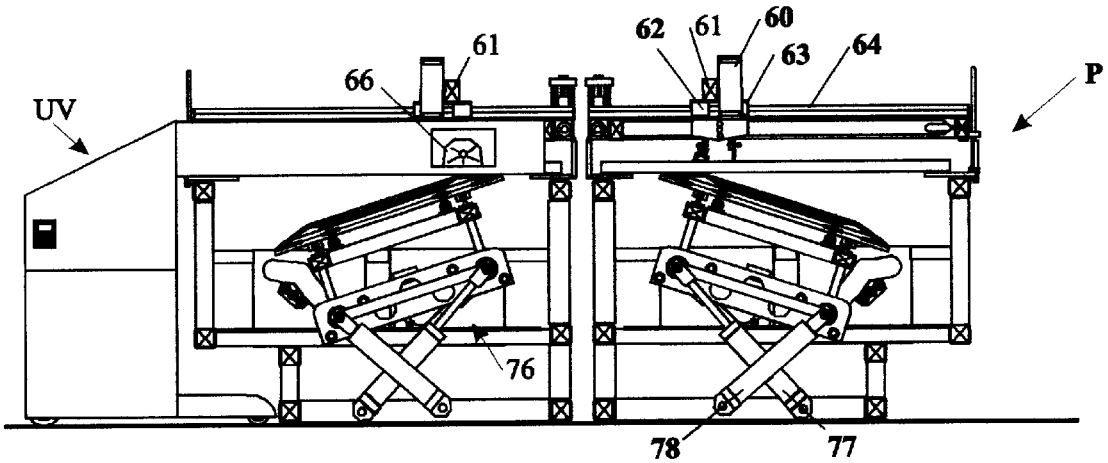
FIG. 8 A side view of an embodiment of the invention.

Now referring to FIG. 5 and the swing arm conveyor A1 is seen a linear actuator 43 which causes a pair of registration pins 44, 45 to reference with two registration forks 38, 39 of the fixture F. The registration pins 44,45 lock in the registration forks 38, 39 that hold the fixture F in a fixed position. The fixture F may now be rotated to align to an adjacent pair of matching rails 35, 36. The fixture F shown in FIG. 5 is position to move to print position P and is referenced by a pair of retractable registration pins 46, 47 which are supported by a pair of linear actuators 48,49 whose function is to move a series of fixtures in a row. All fixtures F maintain equal distance during conveying by means of rail guards 40, 41. Every print/cure station is provided with a pair of locking registration pins typical of 50, 51. All stations' locking registration pins 50,51 are retracted from all registration forks 38,39 during the conveying mode but are interlocked with all registration forks 38, 39 during the rocking mode. A series of fixtures F are pushed along rails 35, 36 and the last fixture F in a row is pushed onto a pair of matching rail segments 52, 53 which are fixed to the opposite swing arm conveyor A2. A retractable shock absorber 55 assembly controls the stopping position of the fixture F on rails 52, 53. All registration pins 50, 51 are now interlocked with all registration forks 38, 39 and the straight sections 35,36, 56, 57 of the press are able to rock as the swing arm conveyors A1,A2 transport fixtures F from one side to the other. Now referring to FIG. 1 looking at a plurality of print heads 60 each with a squeegee and a flood means which travel horizontally over a flat stationary screen. S and said print heads 60 are all interconnected by means of a common beam 61. As beam 61 moves horizontally over flat screen S all print heads 60 and all UV curing lamp housings 66 move in unison. This configuration is extremely desirable because the rocking deck provides a consistent distance between lamp 66 and deck D as seen in FIG. 8. A correct and consistent distance is critical during curing because the light from the UV lamp 66 is only focused at up to a minimal distance. Unfocused light results in inferior curing of the ink. In FIG. 1, beam 61 is attached to a pair of linear bearing assemblies 62, 63 which ride on mounted rails 64, 65. A motor 70 with transmission means causes beam 61 to reciprocate. As the beam 61 reciprocates, a plurality of print heads 60 and UV curing lamp housings 66 move in unison. The apparatus of the invention has the ability to control the sequences of rocking, printing, curving the squeegee, and conveying in several suitable sequences.

Figure 2A:
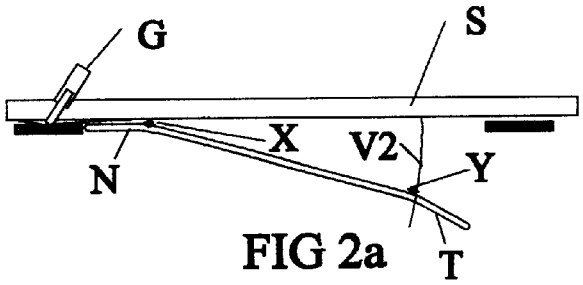
FIGS. 2*a–c* The Rocking Sequence.
Figure 2B:
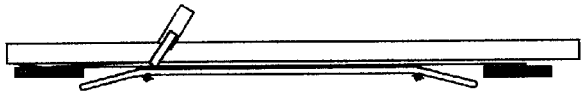
Figure 2C:
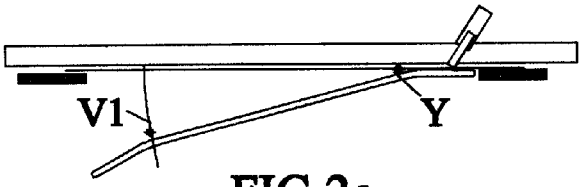
Figure 3A:
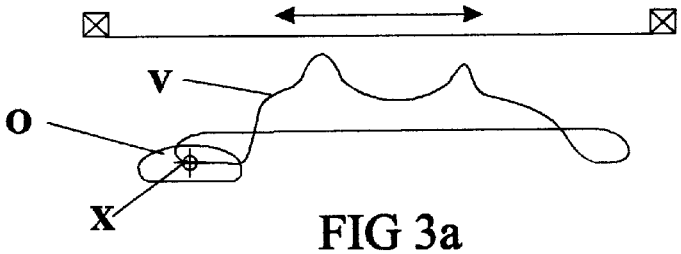
FIG 3a PRIOR ART
FIGS. 3*a,b* Vector comparison.
Figure 3B:
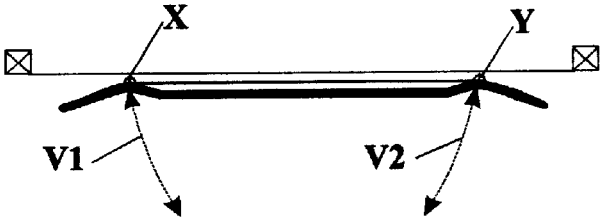
Figure 7A:
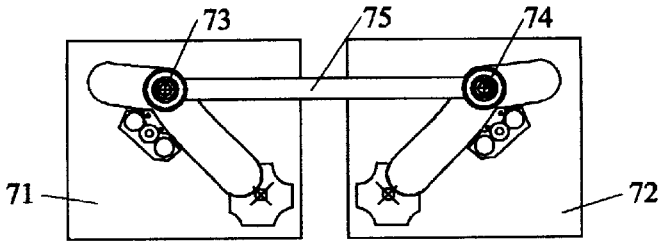
FIGS. 7*a,b,c* Printing position, Conveying position, Rocked position.
Figure 7B:
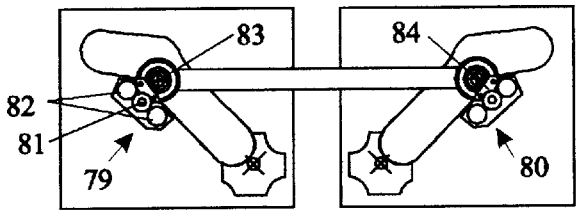
Figure 7C:
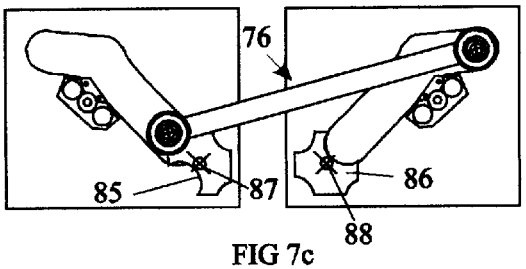

A mechanism controlling the rocking sequence is seen in FIGS. 7*a*–*c* where a left handed cam block 71 and a right handed cam block 72 create a track for cam followers 73,74. Cam followers 73, 74 are maintained at a fixed distance from each other by means of a rocker support frame 75. The rocker frame 75 and cam followers 73,74 are of one assembly which is capable of moving in a rocking sequence whereby two rotational axes points are created at the print surface of the deck as explained in FIG. 2. A pair of linear actuators 77,78 (FIG. 8) power rocker frame 75 to assume all the positions necessary to complete the rocking sequence. FIG. 7*a* is the position the rocker frame 75 assumes for printing the mid-section of a deck. FIG. 7*b* is the position the rocker frame 75 assumes during the conveying mode. During the conveying mode the rocker frame must lower away from the screen to prevent undue contact with wet ink. A cut away section 83, 84 is provided for both the right and left cam blocks 71, 72 in order to accept the cam followers 73, 74 in a lowered position. A cut away portion of the cam blocks 83, 84 is fixed to a linear bearing block 82 and a linear actuator 81 whereby the cut away portion 83 of the cam block is slidably mounted. During the conveying mode a pair of cut away cam block portions 83, 84 slide horizontally out of contact of the cam followers 73,74 which provides a lowered position. During the printing and rocking cycles of the press the cam block portions 83, 84 slide horizontally to contact cam followers 73,74 and to provide a smooth rocking motion.

FIG. 7*c* is the position the rocker frame 75 assumes for the printing of the nose or tail section of a deck. To provide for differing angles and shapes of a deck; a cam limiter 85 is provided. The two limiters 85, 86 in this embodiment of the invention is shown to have four fixed adjustments, which are made by rotation of the limiter 85 around a axis 87,88.

Figure 4A:
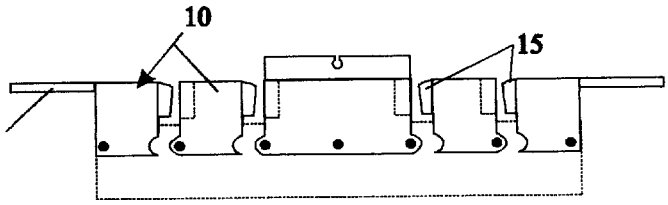
FIGS. 4*a–c* Curvable Squeegee configurations.
Figure 4B:
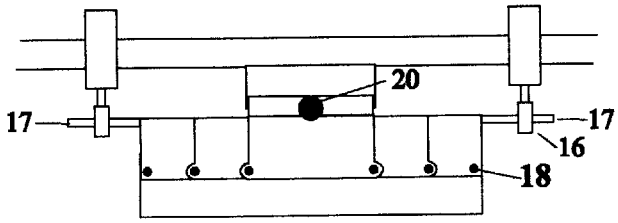
Figure 4C:
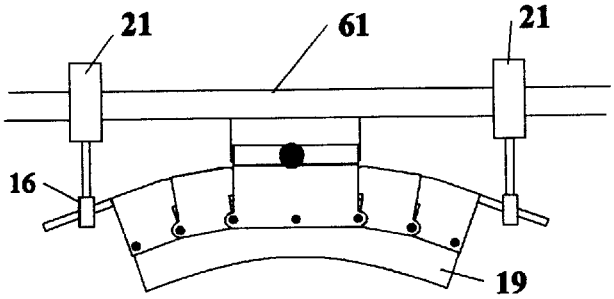

Referring now to a modified squeegee assembly FIG 4*a*. The squeegee must have the ability to automatically adapt or change form to reach the concaved mid section of a short board therefore the squeegee is constructed with means to bend and contort. There are many ways to build such a device. One method is to utilize a multiple of interlocking housings 10 ,which fit together with means to lock in a straight configuration FIG. 4*b* The housings 10 are provided with a plurality of keys 15 which withstand undesirable bending forces. The keys 15 interlock with adjacent housings 10 to provide bending only in one plane. Another method of withstanding undesirable bending is to provide a pair of plates 23 which sandwich the segments 10. A multiple of fastners 18 are shown to clamp down on the squeegee rubber 19, but other simple methods of clamping squeegee rubber exist. An important objective of this invention is to provide a squeegee that is easily removed from the machine and easily cleaned. This objective is fulfilled by providing a pair of rod ends 16 which slidably fit over a pair of bending levers 17. A quick release pin 20 provides support between the beam 61 and the squeegee S. The squeegee is quickly disconnected by releasing pin 20 and sliding the squeegee to one side and then the other. In this particular embodiment of the invention, power is transferred to squeegee by one or more actuators 21 which can be placed at many possible locations and angles. FIG. 4*b* illustrates a straight locked configuration and FIG. 4*c* a curved or contorted configuration.

The squeegee therefore is capable of radically changing shape inside of one print cycle. After a print cycle is complete, the squeegee G (FIG. 8) is lifted away from the screen S and a flood plate 89 scrapes the ink back covering the screen.

I claim:

1. A screen printing apparatus for printing on skateboards, each skateboard having a substantially flat nose section and a substantially flat tail section with a concave shaped mid-section therebetween, each of the nose and tail sections forming a bend at a predetermined angle relative to the mid-section, comprising:

at least one printing station including a flat stationary printing screen and a squeegee with flood means, means for reciprocating said squeegee horizontally over said printing screen, and means for supporting said squeegee so that said squeegee can be selectively maintained in a flat state or in a curved shape, at least one fixture for supporting a skateboard being printed, a loading and/or unloading station for placing and removing the skateboard on and from said at least one fixture, an intermittent conveyor for transporting said at least one fixture through said loading and/or unloading station and said at least one printing station in a predetermined path, means disposed on said at least one fixture for registering said skateboard with said printing screen at said at least one printing station, means for pivoting the skateboard about two axes located directly at the bends in accordance with the movement of said squeegee in a timed manner so that each of the sections of the skateboard is disposed parallel to the printing screen during printing, and said means for reciprocating said squeegee further comprising means disposed in a first position for maintaining said squeegee in a flat state when said squeegee moves across the nose and tail sections of the skateboard and in a second position for forcing said squeegee into a curved shape conforming to the curvature of the mid-section of the skateboard when said squeegee moves across the mid-section of the skateboard.

* * * * *